US010116096B1

(12) United States Patent
Anderson et al.

(10) Patent No.: US 10,116,096 B1
(45) Date of Patent: Oct. 30, 2018

(54) INTERCONNECT SYSTEM WITH FRICTION FIT BACKSHELL

(71) Applicant: National Technology & Engineering Solutions of Sandia, LLC, Albuquerque, NM (US)

(72) Inventors: Arden Anderson, Albuquerque, NM (US); Jonathan Ogaldez, Albuquerque, NM (US)

(73) Assignee: National Technology & Engineering Solutions of Sandia, LLC, Albuqueque, NM (US)

( * ) Notice: Subject to any disclaimer, the term of this patent is extended or adjusted under 35 U.S.C. 154(b) by 0 days.

(21) Appl. No.: 15/786,136

(22) Filed: Oct. 17, 2017

Related U.S. Application Data

(60) Provisional application No. 62/409,983, filed on Oct. 19, 2016.

(51) Int. Cl.
*H01R 13/6581* (2011.01)
*H01R 13/6593* (2011.01)
(Continued)

(52) U.S. Cl.
CPC ..... *H01R 13/6581* (2013.01); *H01R 13/516* (2013.01); *H01R 13/5205* (2013.01); *H01R 13/5804* (2013.01); *H01R 13/6593* (2013.01)

(58) Field of Classification Search
CPC ..... H01R 13/6581; H01R 13/6593; H01R 13/516; H01R 13/5205; H01R 13/5804; H01R 13/5808
(Continued)

(56) References Cited

U.S. PATENT DOCUMENTS 7,544,085 B2 * 6/2009 Baldwin ..... H01R 13/5829 439/446
7,735,876 B2 * 6/2010 Chiu ..... F16L 5/00 174/655
(Continued)

OTHER PUBLICATIONS

"Backshell Assy, 90° Low Profile MIL-C-38999, SER 1&2, Size 24/25 Dual Entry Band Termination", Kern Engineering & Mfg. Corp., Retrieved at: <<http://kerneng.com/pdfs/Circulars/DUAL%20Entry/Dual-Entry-Circ%207.pdf>>, 2003, 1 page.
(Continued)

*Primary Examiner* — Harshad C Patel
(74) *Attorney, Agent, or Firm* — Medley, Behrens & Lewis, LLC; Samantha Updegraff

(57) ABSTRACT

Various technologies described herein pertain to interconnect systems for electrical cables. An interconnect system can include a connector, an adapter ring, and a backshell. The connector includes a threaded distal coupling portion. The adapter ring includes a threaded proximal coupling portion and a non-threaded distal coupling portion. The backshell includes a proximal coupling portion and a port. The threaded proximal coupling portion of the adapter ring and the threaded distal coupling portion of the connector can be mechanically attached. Additionally, the proximal coupling portion of the backshell and the non-threaded distal coupling portion of the adapter ring can be mechanically attached. A wire bundle can enter the backshell through the port, pass through the adapter ring, and terminate at the connector. A shield that encloses the wire bundle can terminate at the backshell such that an end of the shield is positioned around an outer surface of the port.

12 Claims, 12 Drawing Sheets

(51) Int. Cl.
*H01R 13/52* (2006.01)
*H01R 13/58* (2006.01)
*H01R 13/516* (2006.01)

(58) Field of Classification Search
USPC ..... 439/607.41, 578–595
See application file for complete search history.

(56) References Cited

U.S. PATENT DOCUMENTS

| | | | | |
|---|---|---|---|---|
| 7,892,004 | B2 * | 2/2011 | Hertzler | H01R 13/5219 439/312 |
| 8,393,919 | B2 * | 3/2013 | Islam | H01R 9/0521 439/584 |
| 2002/0123263 | A1 * | 9/2002 | Lazaro, Jr. | H01R 13/424 439/459 |
| 2007/0224880 | A1 * | 9/2007 | Wlos | H01R 9/0527 439/578 |
| 2008/0182451 | A1 * | 7/2008 | Amidon | H01R 9/0521 439/583 |
| 2009/0264003 | A1 * | 10/2009 | Hertzler | H01R 13/5219 439/299 |
| 2011/0070766 | A1 * | 3/2011 | Lindkamp | H01R 13/5812 439/462 |
| 2011/0226084 | A1 * | 9/2011 | Chiou | F16C 1/102 74/502.4 |
| 2012/0115363 | A1 * | 5/2012 | Myong | H01R 4/01 439/607.41 |
| 2014/0145436 | A1 * | 5/2014 | Charcenko | F16L 5/06 285/355 |
| 2014/0273583 | A1 * | 9/2014 | Baldwin | H01R 13/622 439/314 |

OTHER PUBLICATIONS

"Backshells from Amphenol PCD", Amphenol, Retrieved at: <<http://www.amphenol-aerospace.com/pdf/catalogs/Backshells_16.pdf>>, Retrieval Date: Oct. 16, 2017, pp. 478-553.
"Band-Master ATS", Glenair, Jun. 2014, 18 pages.
"Catalog 1654025", TE Connectivity, Mar. 2013, pp. 6-1-6-86.
"Straight Backshell, W1P5, Multi-Port Band-Termination, for MS27656T25B42SN Connector", Kern Engineering & Mfg. Corp., Retrieved at: <<http://kerneng.com/pdfs/Circulars/DUAL%20Entry/Dual-Entry-Circ%2018.pdf>>, 2005, 1 page.
"Straight Shield Termination Backshell for MIL-C-38999 Series I and II Shell Size 16/17, Dual Entry", Kern Engineering & Mfg. Corp., Retrieved at: <<http://kerneng.com/pdfs/Circulars/DUAL%20Entry/Dual-Entry-Circ%2012.pdf>>, 1998, 1 page.
"Assembly Instructions", Kern Engineering & Manufacturing Corporation, Retrieved at: <<http://kerneng.com/circulars.html>>, Retrieval Date: Oct. 17, 2017, 1 page.
"Circular", Kern Engineering & Manufacturing, Retrieved at: <<http://kerneng.com/circulars.html>>, Retrieval Date: Oct. 17, 2017, 1 page.
"Amphenol Aerospace: Backshells", Retrieved at: <<http://www.amphenol-aerospace.com/16-backshells>>, Retrieval Date: Oct. 17, 2017, 2 pages.
"Circular Connector Backshells and Accessories", Glanair, Retrieved at: <<https://www.glenair.com/backshells/circular/index.htm>>, Retrieval Date: Oct. 17, 2017, 6 pages.
"Circular Backshells", Polamco, Retrieved at: <<http://www.polamco.com/product-lines/backshells/circularl>>, Retrieval Date: Oct. 17, 2017, 2 pages.

* cited by examiner

INTERCONNECT SYSTEM WITH FRICTION FIT BACKSHELL

RELATED APPLICATION

This application claims priority to U.S. Provisional Patent Application No. 62/409,983, filed on Oct. 19, 2016, entitled "INTERCONNECT SYSTEM AND METHOD OF OPERATING THE SAME", the entirety of which is incorporated herein by reference.

STATEMENT OF GOVERNMENTAL INTEREST

This invention was made with Government support under Contract No. DE-NA0003525 awarded by the United States Department of Energy/National Nuclear Security Administration. The U.S. Government has certain rights in the invention.

BACKGROUND

Electrical cables can include one or more wires that terminate at connectors. Further, the connectors used for many electrical cables are circular connectors. Examples of circular connectors commonly utilized in various industries, such as the aerospace industry, are Long Junior Tri-Lock (LJT) connectors or D38999 connectors.

Electrical cables oftentimes include shields; for instance, wire(s) of a cable can be enclosed within a shield, where the shield is a conductive layer. Shields help to electrically isolate signals from each other. Thus, a shield can mitigate electromagnetic interference (EMI) (e.g., outside noise that penetrates and couples onto signals within a cable) and/or electromagnetic radiation (EMR) (e.g., signals within a cable that escape and radiate elsewhere). Examples of shields include braided metal shields and non-braided spiral metal shields. Shields can be formed of cooper, aluminum, silver, or other types of conductors.

Conventionally, backshells are utilized to terminate shielded cables to circular connectors. A backshell can allow for a metal enclosure or casing to be around signal carrying wire(s) from a shield to a connector, which can minimize EMI and EMR. Thus, the backshell and the shield can act as a Faraday cage to reduce EMI and EMR. Bridging of the shield to the connector without leaving a gap can be referred to as 360 degree shield termination.

Some electrical cables may include more than one wire bundle that exit the connector. Each of the wire bundles can be within respective shields. Conventional approaches for terminating multiple shielded wire bundles to a single connector, however, can be difficult and time consuming (e.g., shields may be joined by soldering, multi-piece backshells may be soldered). Moreover, such traditional approaches may be subject to failure (e.g., flux used for soldering may potentially migrate towards contacts and pose a corrosion risk) and occupy relatively large potting volumes (e.g., which impact space and weight of the overall assembly). The potting volume refers to a shape and size of a cable-to-connector transition behind a connector.

SUMMARY

Described herein are various technologies that pertain to interconnect systems for electrical cables. An interconnect system can include a connector, an adapter ring, and a backshell. The connector can include a threaded distal coupling portion. Moreover, the adapter ring can include a threaded proximal coupling portion and a non-threaded distal coupling portion. Further, the backshell can include a proximal coupling portion and a port. The threaded proximal coupling portion of the adapter ring and the threaded distal coupling portion of the connector can be mechanically attached. Additionally, the proximal coupling portion of the backshell and the non-threaded distal coupling portion of the adapter ring can be mechanically attached. A wire bundle can enter the backshell through the port, pass through the adapter ring, and terminate at the connector. A shield can terminate at the backshell such that an end of the shield is positioned around an outer surface of the port, where the wire bundle is within the shield. According to various embodiments, the backshell can further include a differing port; thus, a differing wire bundle can enter the backshell through the differing port, pass through the adapter ring, and terminate at the connector (e.g., a differing shield in which the differing wire bundle is located can terminate at the differing port of the backshell).

Pursuant to various embodiments, the proximal coupling portion of the backshell can include fingers separated by gaps. The proximal coupling portion of the backshell and the non-threaded distal coupling portion of the adapter ring can be mechanically attached through a friction fit between inner surfaces of the fingers of the proximal coupling portion of the backshell and an outer surface of the non-threaded distal coupling portion of the adapter ring.

In accordance with various embodiments, assembling the interconnect system can include positioning the wire bundle to pass through the port of the backshell and the adapter ring. Further, the wire bundle can be attached to the connector. The threaded proximal coupling portion of the adapter ring can be attached to the threaded distal coupling portion of the connector. Thereafter, the proximal coupling portion of the backshell can be attached to the non-threaded distal coupling portion of the adapter ring (e.g., the proximal coupling portion of the backshell can be slipped onto the non-threaded distal coupling portion of the adapter ring, which can reduce disturbance of routing of wire(s) inside the backshell and the adapter ring). Further, a band clamp can be positioned around an outer surface of the proximal coupling portion of the backshell (e.g., outer surfaces of the fingers of the proximal coupling portion of the backshell). Moreover, an end of a shield can be positioned around an outer surface of the port of the backshell (where the wire bundle is within the shield), and a differing band clamp can be positioned around an outer surface of the shield at the end of the shield.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
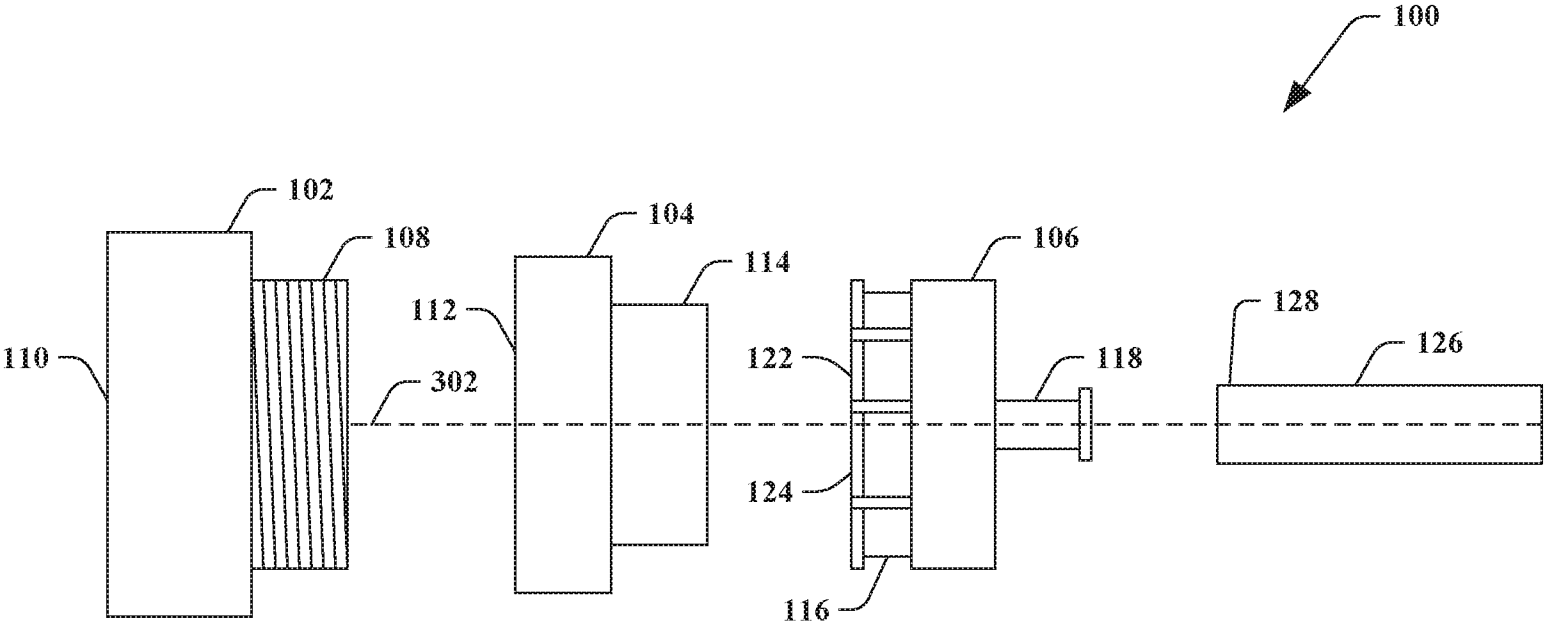
FIG. 1 illustrates an exemplary interconnect system.

Various technologies pertaining to interconnect systems for electrical cables are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Referring now to the drawings, FIG. 1 illustrates an exemplary interconnect system 100. The interconnect system 100 includes a connector 102, an adapter ring 104, and a backshell 106. The connector 102 and the adapter ring 104 are mechanically attachable to each other. Moreover, the adapter ring 104 and the backshell 106 are mechanically attachable to each other. A wire bundle can enter the backshell 106 (e.g., through a port such as a port 118 shown in FIG. 1), pass through the adapter ring 104, and terminate at the connector 102. For instance, the wire bundle can be positioned along the dotted line shown in FIG. 1.

The connector 102 can be a circular connector, for example. The connector 102 can include a threaded distal coupling portion 108. The threaded distal coupling portion 108 can include external threads; thus, hardware that mounts to the back of the connector 102 (e.g., on the threaded distal coupling portion 108) is to be threaded. Moreover, the connector 102 can include a mating end 110. The mating end 110 can include half of a mating pair; accordingly, the mating end 110 can include a plug or a receptacle (e.g., if the mating end 110 includes a plug then the mating end 110 can mate with a receptacle separate from the interconnect system 100, if the mating end 110 includes a receptacle then the mating end 110 can mate with a plug separate from the interconnect system 100). As noted above, a wire bundle (or wire bundles) can terminate at the connector 102.

Moreover, the adapter ring 104 includes a threaded proximal coupling portion 112 and a non-threaded distal coupling portion 114. The threaded proximal coupling portion 112 can include internal threads. Thus, the threaded proximal coupling portion 112 of the adapter ring 104 and the threaded distal coupling portion 108 of the connector 102 can be mechanically attached (e.g., the threaded proximal coupling portion 112 and the threaded distal coupling portion 108 can be screwed together). While the examples set forth herein describe the threaded proximal coupling portion 112 of the adapter ring 104 having internal threads and the threaded distal coupling portion 108 of the connector 102 having external threads, it is contemplated that alternatively the threaded proximal coupling portion 112 of the adapter ring 104 can have external threads and the threaded distal coupling portion 108 of the connector 102 can have internal threads. Further, the adapter ring 104 defines a passage way through which wire bundle(s) can pass.

The backshell 106 can further include a proximal coupling portion 116 and a port 118. A wire bundle can enter the backshell 106 through the port 118. While the backshell 106 of FIG. 1 is depicted to include one port (e.g., the port 118), it is contemplated that the backshell 106 can alternatively include more than one port (e.g., one wire bundle can enter a first port and a differing wire bundle can enter a second port). Moreover, while the port 118 of the backshell 106 shown in FIG. 1 is oriented to allow for straight entry (e.g., 0 degree entry angle), it is contemplated that the port 118 can alternatively be oriented to allow for angled entry. The entry angle can be relative to an axis through the backshell 106 (along the dotted line shown in FIG. 1). For instance, some exemplary backshells depicted herein have port(s) at 90 degree entry angles; however, it is contemplated that the port(s) can instead be oriented at substantially any other entry angle (e.g., 30 degrees, 45 degrees, 60 degrees). According to another example, it is contemplated that a backshell can include ports oriented at differing entry angles (e.g., a first port can be oriented at a 0 degree entry angle, a second port can be oriented at a 45 degree entry angle, and a third port can be oriented at a 90 degree entry angle); yet, the claimed subject matter is not so limited.

The proximal coupling portion 116 of the backshell 106 and the non-threaded distal coupling portion 114 of the adapter ring 114 can be mechanically attached. When mechanically attached, the non-threaded distal coupling portion 114 of the adapter ring 114 can be positioned within the proximal coupling portion 116 of the backshell 106.

The proximal coupling portion 116 of the backshell 106 can include fingers separated by gaps. Examples of fingers of the proximal coupling portion 116 depicted in FIG. 1 include a finger 122 and a finger 124, which are separated by a gap. Moreover, the proximal coupling portion 116 and the non-threaded distal coupling portion 114 can be mechanically attached through a friction fit between inner surfaces of the fingers of the proximal coupling portion 116 of the backshell 106 and an outer surface of the non-threaded distal coupling portion 114 of the adapter ring 104. Thus, the proximal coupling portion 116 of the backshell 106 can be slipped onto the non-threaded distal coupling portion 114 of the adapter ring 104, which can reduce disturbance of routing of wire(s) inside the backshell 106 and the adapter ring 104.

FIG. 1 also depicts a shield 126. A wire bundle can be within the shield 126. The shield 126 can be formed of cooper, aluminum, silver, or other types of conductors. Moreover, the shield 126 can be a braided shield, a non-braided spiral shield, or substantially any other type of shield. The shield 126 can terminate at the backshell 106 such that an end 128 of the shield 126 is positioned around an outer surface of the port 118. When the end 128 of the shield 126 is positioned around the outer surface of the port 118, the wire bundle can extend from the shield 126, enter the backshell 106 through the port 118, pass through the adapter ring 104, and terminate at the connector 102.

The backshell 106 and adapter ring 104 of the interconnect system 100 can eliminate the need for soldering shields to each other or soldering backshell halves together. Rather than soldering, the adapter ring 104 can be mechanically attached to the connector 102 (e.g., screwed together), and the backshell 106 can be mechanically attached to the adapter ring 104 (e.g., slipped over and held in place via a friction fit). When the non-threaded distal coupling portion 114 of the adapter ring 114 is positioned within the proximal coupling portion 116 of the backshell 106, a band clamp can be positioned around an outer surface of the proximal coupling portion 116 of the backshell 106. Accordingly, the band clamp can further secure the mechanical attachment between the non-threaded distal coupling portion 114 of the adapter ring 114 and the proximal coupling portion 116 of the backshell 106. Band clamp(s) can likewise be positioned around outer surface(s) of shield(s) when end(s) of the shield(s) are positioned around outer surface(s) of port(s) of the backshell 106. Thus, the band clamp(s) can be used to terminate shield(s) at the port(s) of the backshell 106.

In contrast to the interconnect system 100 (assuming that the backshell 106 includes a plurality of ports), conventional approaches for terminating multiple shields into a single connector can include bringing the wires from one wire bundle into a shield that houses another bundle or using a shield sock that envelops the shields of the incoming bundles. With either of these approaches, the shields are to be joined, typically by soldering the shields together. Another traditional approach for terminating multiple shielded wire bundles into a single connector can involve use of a custom backshell; however, since conventional backshells typically thread onto circular connectors and it is undesirable to twist the terminated wires once they have been soldered to the connector, some conventional approaches use two piece backshell designs.

Bringing wires from one bundle into a shield of another bundle or using a shield sock can require time and care to solder the shields together (e.g., to avoid melting wire jacketing underneath). Moreover, a relatively large potting volume may be needed to encapsulate a soldered area. Further, a disadvantage of the two piece backshell design is that the two halves are typically soldered together. Flux used in soldering is often cleaned off after the soldering. Soldering along the seam of the two backshell halves can require flux that, once soldered, cannot be cleaned from the inside of the backshell, where it could potentially migrate toward the contacts and pose a corrosion risk.

Figure 2:
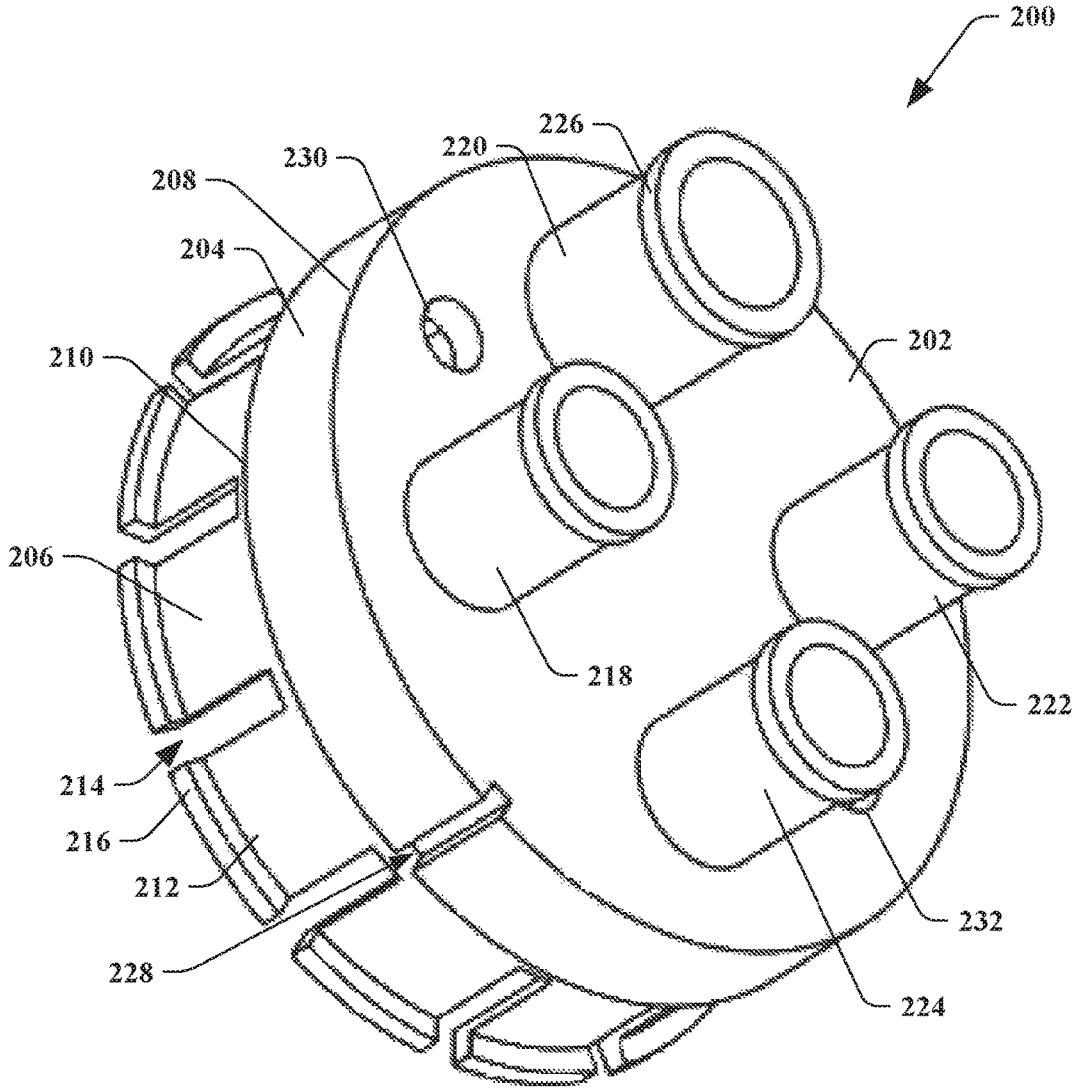
FIG. 2 illustrates an isometric view of an exemplary backshell.

Turning to FIG. 2, illustrated is an isometric view of an exemplary backshell 200 (e.g., the backshell 106 of FIG. 1). The backshell 200 includes a cap portion 202, a sidewall portion 204, and a proximal coupling portion 206 (e.g., the proximal coupling portion 116 of FIG. 1). The sidewall portion 204 includes a first end 208 and a second end 210. The cap portion 202 of the backshell 200 is adjacent to the first end 208 of the sidewall portion 204 of the backshell 200 such that the cap portion 202 closes the sidewall portion 204 at the first end 208. Moreover, the proximal coupling portion 206 is adjacent to the second end 210 of the sidewall portion 204 of the backshell 200. As described herein, the proximal coupling portion 206 includes fingers separated by gaps. As an illustration, the fingers of the proximal coupling portion 206 include a finger 212, and the gaps include a gap 214.

The fingers of the proximal coupling portion 206 of the backshell 200 can include rims on outer surfaces of the fingers at tips of the fingers. For instance, the finger 212 can include a rim 216 on an outer surface of the finger 212 at a tip of the finger 212. Other fingers of the proximal coupling portion 206 can similarly include respective rims. If a band clamp is positioned around outer surfaces of the fingers of the proximal coupling portion 206 of the backshell 200, the rims can mitigate the band clamp from slipping off the outer surfaces of the fingers.

As noted herein, a backshell includes one or more ports. For example, a port can be located on a cap portion of a backshell (e.g., providing a 0 degree entry angle). Additionally or alternatively, a port can be located on a sidewall portion of a backshell (e.g., providing a 90 degree entry angle). However, it is also contemplated that other entry angles are intended to fall within the scope of the hereto appended claims.

In the example depicted in FIG. 2, the backshell 200 includes a plurality of ports, namely, a port 218, a port 220, a port 222, and a port 224 (collectively referred to herein as ports 218-224). The ports 218-224 are each located on the cap portion 202 of the backshell 200. The ports 218-224 each provide a 0 degree entry angle for a respective wire bundle to enter the backshell 200. While the backshell 200 of FIG. 2 includes four ports 218-224, it is to be appreciated that a backshell can alternatively include fewer than four or more than four ports.

The ports 218-224 can each include a rim on an outer surface. For instance, the port 220 can include a rim 226 on an outer surface at an end of the port 220. The other ports (e.g., the port 218, the port 222, and the port 224) can similarly include respective rims. Again, the rims help mitigate band clamps from slipping. Thus, if a shield is terminated at the backshell 200 such that an end of the shield is positioned around an outer surface of the port 220 and a band clamp is positioned around an outer surface of the shield at the end of the shield, then the rim can help maintain the band clamp in such position.

The backshell 200 can also include an orientation notch 228. The orientation notch 228 can be on the sidewall portion 204 of the backshell 200. The orientation notch 228 allows for aligning the backshell 200 in a particular defined orientation relative to a connector (e.g., the connector 102 of FIG. 1). For instance, the orientation notch 228 can be aligned with a major key of a connector. Yet, it is contemplated that the backshell 200 can additionally or alternatively include other types of orientation markers that differ from the orientation notch 228.

The backshell 200 can also include a fill hole 230 and a fill hole 232 (collectively referred to herein as fill holes 230-232). The fill holes 230-230 allow for potting material to be injected into the backshell 200. The potting material can encapsulate an inside volume of the backshell 200 (e.g., subsequent to the backshell 200 being secured to an adapter ring with wire bundle(s) passing therethrough).

Figure 3:
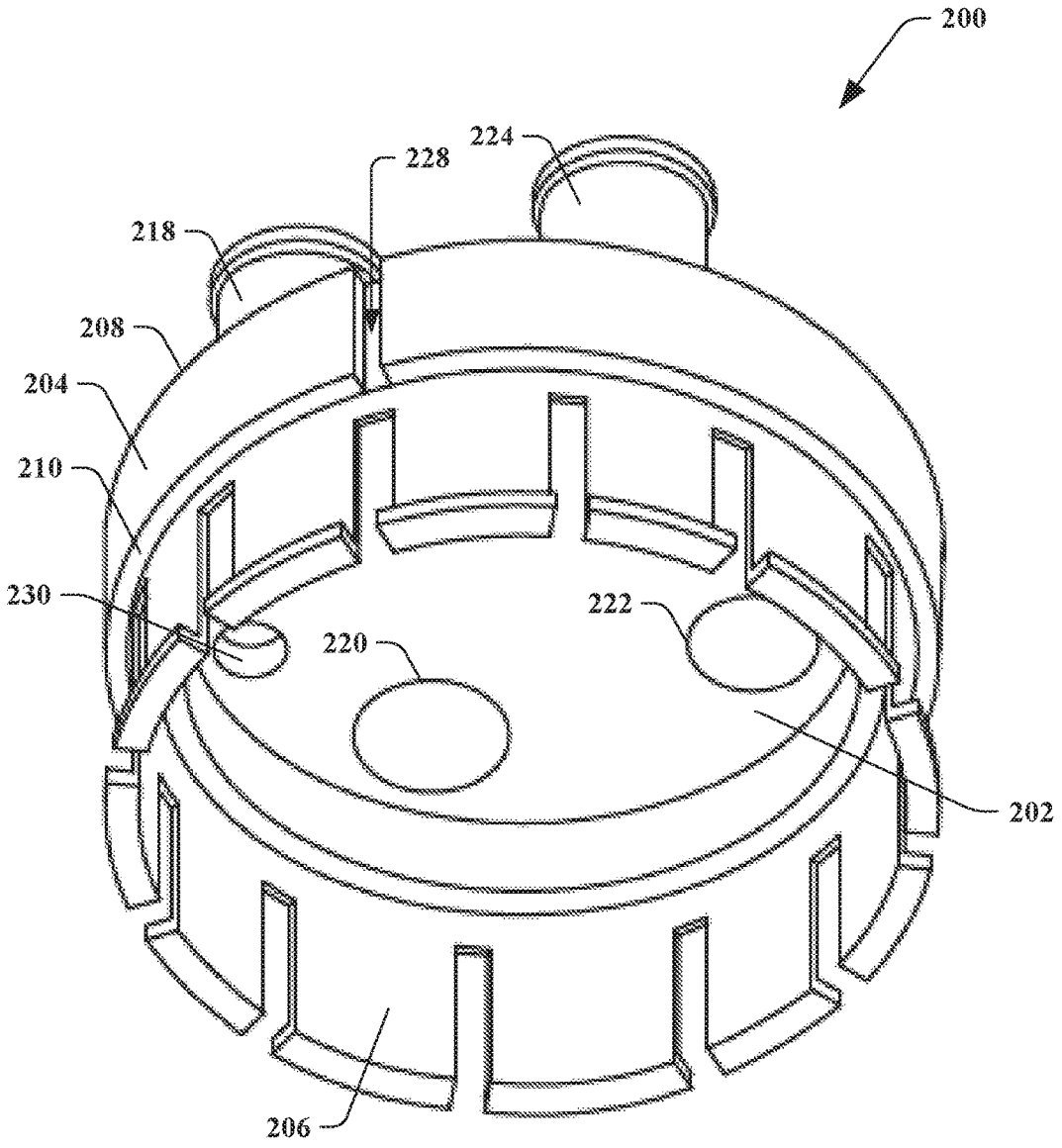
FIG. 3 illustrates another isometric view of the backshell of FIG. 2.

Turning to FIG. 3, illustrated is another isometric view of the backshell 200 of FIG. 2. An inside surface of the proximal coupling portion 206 (e.g., inside surfaces of the fingers) can mate to a non-threaded distal coupling portion of an adapter ring (e.g., the non-threaded distal coupling portion 114 of the adapter ring 104). Accordingly, the inside surface of the proximal coupling portion 206 can be formed with tight tolerance (relative to tolerances of other dimensions of the backshell 200).

Figure 4:
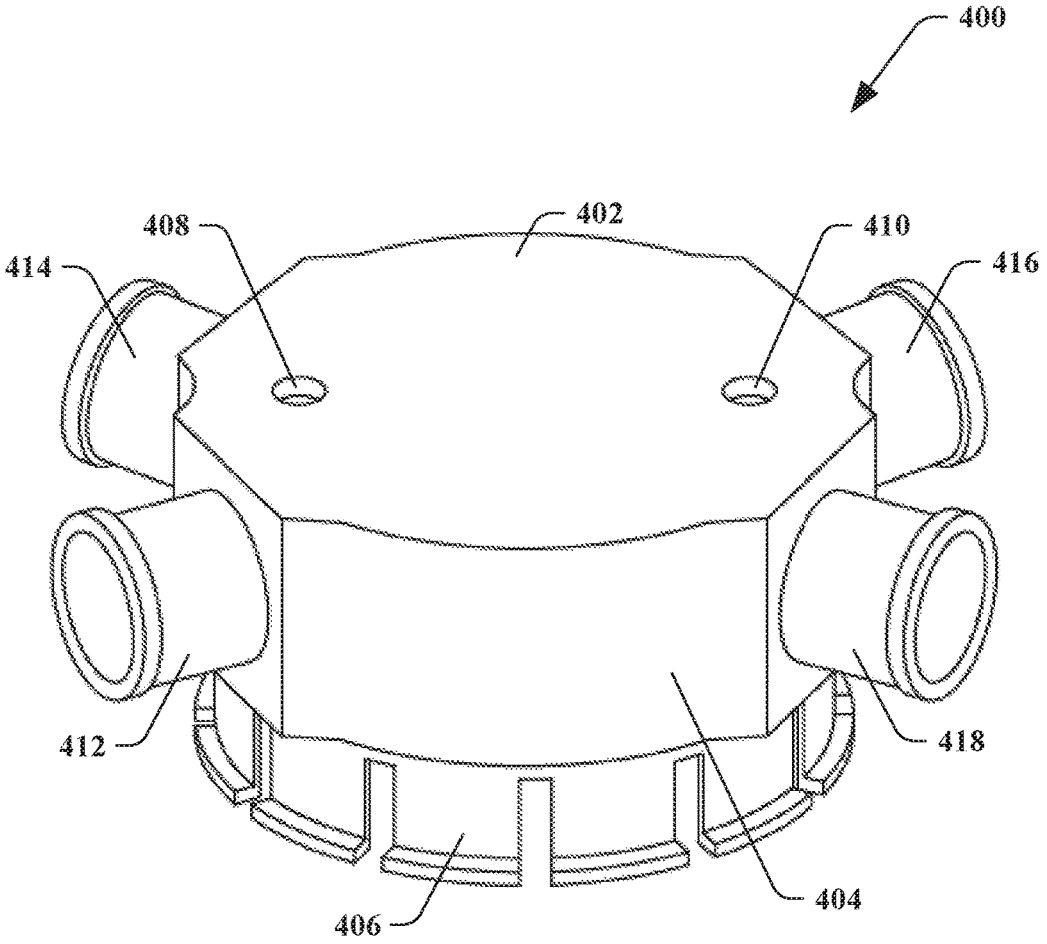
FIG. 4 illustrates an isometric view of another exemplary backshell.

Now referring to FIG. 4, illustrated is an isometric view of another exemplary backshell 400 (e.g., the backshell 106 of FIG. 1). Similar to the backshell 200 depicted in FIGS. 2-3, the backshell 400 includes a cap portion 402, a sidewall portion 404, and a proximal coupling portion 406. Moreover, the proximal coupling portion 406 includes fingers separated by gaps. The backshell 400 further can include fill holes 408-410.

In the example set forth in FIG. 4, the backshell 400 includes a plurality of ports, namely, a port 412, a port 414, a port 416, and a port 418 (collectively referred to herein as ports 412-418). The ports 412-418 are each located on the sidewall portion 404 of the backshell 400. The ports 412-418 each provide a 90 degree entry angle to the backshell 400. In the depicted example, the port 412 and the port 414 are positioned 60 degrees apart from each other around the sidewall portion 404 of the backshell 400, and the port 416 and the port 418 are positioned 60 degrees apart from each other around the sidewall portion 404 of the backshell 400. However, other relative positioning of the ports 412-418 are intended to fall within the scope of the hereto appended claims (e.g., the ports 412-418 can be positioned at 90 degree increments around the sidewall portion 404 of the backshell 400).

Figure 5:
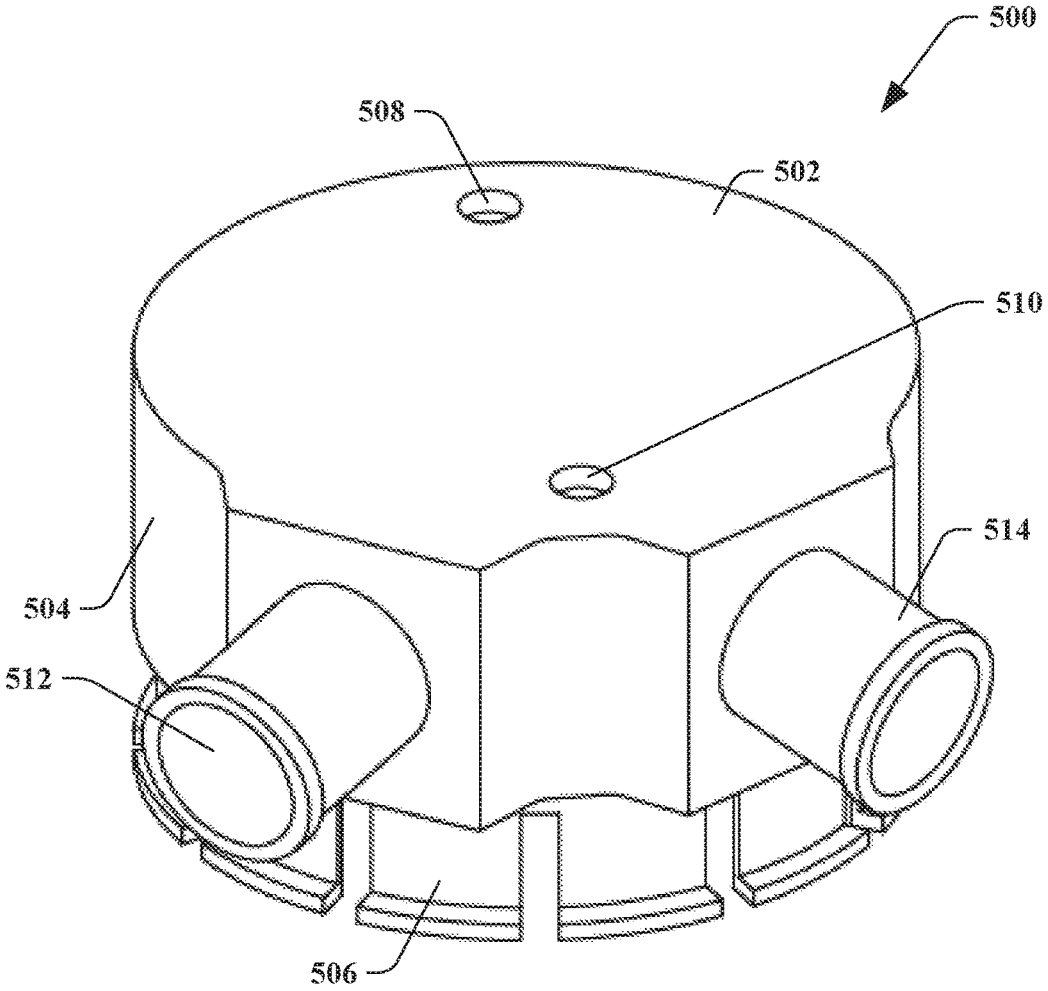
FIG. 5 illustrates an isometric view of yet another exemplary backshell.

FIG. 5 illustrates an isometric view of yet another exemplary backshell 500 (e.g., the backshell 106 of FIG. 1). Again, the backshell 500 includes a cap portion 502, a sidewall portion 504, and a proximal coupling portion 506. The proximal coupling portion 506 further includes fingers separated by gaps. The backshell 500 can further include fill holes 508-510.

Similar to the example shown in FIG. 4, the backshell 500 includes a plurality of ports (a port 512 and a port 514) that are each located on the sidewall portion 504 of the backshell 500. However, the backshell includes two ports 512-514 as opposed to four ports 412-418 being included in the backshell 400. Moreover, the ports 512-514 can be positioned at a 60 degree angle relative to each other around the sidewall portion 504 of the backshell 500. Yet, it is contemplated that other orientations of ports relative to each other are intended to fall within the scope of the hereto appended claims. Moreover, it is to be appreciated that a backshell can include other numbers of ports located on a sidewall portion (other than two ports 512-514 as shown in FIG. 5 or four ports 412-418 as shown in FIG. 4).

Reference is now generally made to the backshells described herein. A backshell can be formed of a conductive material. For example, a backshell can be formed of nickel coated aluminum or cadmium coated aluminum. However, other conductive materials can additionally or alternatively be used to form a backshell. Examples of other conductive materials that can be used to form a backshell include stainless steel, copper, and conductively coated plastic. According to an illustration, the material used to form the backshell can match the material from which an adapter ring is formed; such use of matching materials can minimize differences in thermal expansion when exposed to hot or cold temperatures.

Designs of the backshells described herein optimize a tradeoff between functionality and manufacturability. For instance, a backshell can be designed to enable mechanical attachment with an adapter ring through a friction fit between a proximal coupling portion of the backshell and a non-threaded distal coupling portion of the adapter ring. Moreover, a volume occupied by the backshell in a cable assembly (e.g., potting volume) can be minimized, while maximizing space for wires to route from entry at port(s) to connector terminals. With respect to manufacturability of the backshells, relatively large tolerances can be used for many of the dimensions of the backshells (with an inside surface of the proximal coupling portion having a tighter tolerance in comparison).

Pursuant to an example, a backshell can be machined from a single piece of material (e.g., a single piece of aluminum). For instance, machining operations can be accomplished on a lathe and/or using a Computer Numerical Control (CNC) machine (a computer controlled machine that combines a lathe, mill, router, and grinder). Gaps between fingers of a backshell can be machined using a Wire Electrical Discharge Machine (EDM), which can remove material using an electric field, allowing material to flow from a part or workpiece (used as an electrode) toward an opposite electrode (a wire) through a dielectric liquid. Moreover, to machine rims on ports, an end mill that fits between the ports and removes material beneath the rims can be utilized. However, it is contemplated that other manufacturing processes can additionally or alternatively be used to make the backshell; for instance, 3D printing (additive manufacturing) can be used to manufacture the backshell.

The backshells set forth herein can be slipped on to a non-threaded distal coupling portion of an adapter ring as opposed to being threaded. In contrast, a backshell that includes a threaded proximal coupling portion (instead of the proximal coupling portion including the fingers separated by gaps) would require wire(s) positioned inside to rotate as such backshell is mated to a threaded distal coupling portion of a connector. Slipping a backshell that includes the proximal coupling portion having the fingers separated by gaps on to the non-threaded distal coupling portion of the adapter ring allows the backshell to be mated (to the connector via the adapter ring) with minimal disturbance to the routing of the wire(s) inside.

Moreover, while the adapter ring and the backshell described herein are separate components, joining of these parts can be accomplished by slipping the backshell on to the adapter ring and using a band clamp (rather than soldering). Installing a band clamp can be a faster, easier process as compared to soldering, and unlike soldering, does not leave a flux residue that can pose a corrosion risk.

Further, the backshell set forth herein can accommodate multiple wire bundles without requiring shields to be joined together by soldering. Instead, each shield can be terminated to a respective port of the backshell using a band clamp.

Additionally, the backshells set forth herein can occupy smaller potting volumes as compared to many conventional backshells. In an electronics assembly, space oftentimes is limited. Less space required above a connector for potting (e.g., the potting height) can lead to more options for optimization of a remainder of the assembly. Accordingly, lowering the potting height can be desired. Moreover, it can be desired to minimize a distance to where a cable can first bend. The backshells described herein can minimize both criteria.

Figure 6:
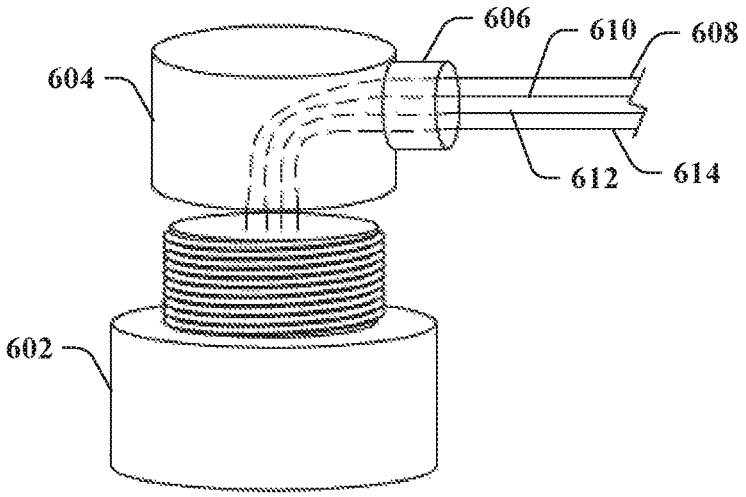
FIG. 6 and FIG. 7 illustrate examples of backshells including threaded proximal coupling portions.
Figure 7:
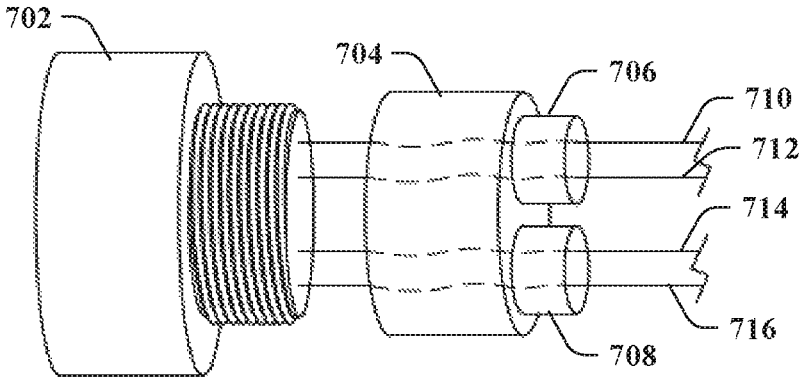

With reference to FIGS. 6-7, illustrated are examples of backshells including threaded proximal coupling portions. FIG. 6 depicts a connector 602 and a backshell 604 having a port 606 at a 90 degree entry angle. Four wires 608-614 are shown as entering the port 606. Moreover, FIG. 7 depicts a connector 702 and a backshell 704 having two ports (a port 706 and a port 708), each at a 0 degree entry angle. Again, four wires are shown as entering the backshell 704 (wires 710 and 712 enter the port 706, and wires 714 and 716 enter the port 708). The backshell 604 in FIG. 6 and the backshell in FIG. 7 are each threaded to enable mounting to backs of the connectors 602 and 604, respectively. However, mechanical attachment of the backshells and connectors depicted in FIGS. 6-7 can be impractical. More particularly, rotating the backshell 604 relative to the connector 602 to thread the backshell 604 onto the connector 602 will twist the wires 608-614 inside the backshell 604. Likewise, rotating the backshell 704 relative to the connector 702 to thread the backshell 704 onto the connector 702 will twist the wires 710-716 inside the backshell 704. Accordingly, it is desirable to alternatively employ backshells lacking the threaded proximal coupling portion that can be slid onto adapter rings, which can reduce disturbance of routing of wire(s).

Figure 8:
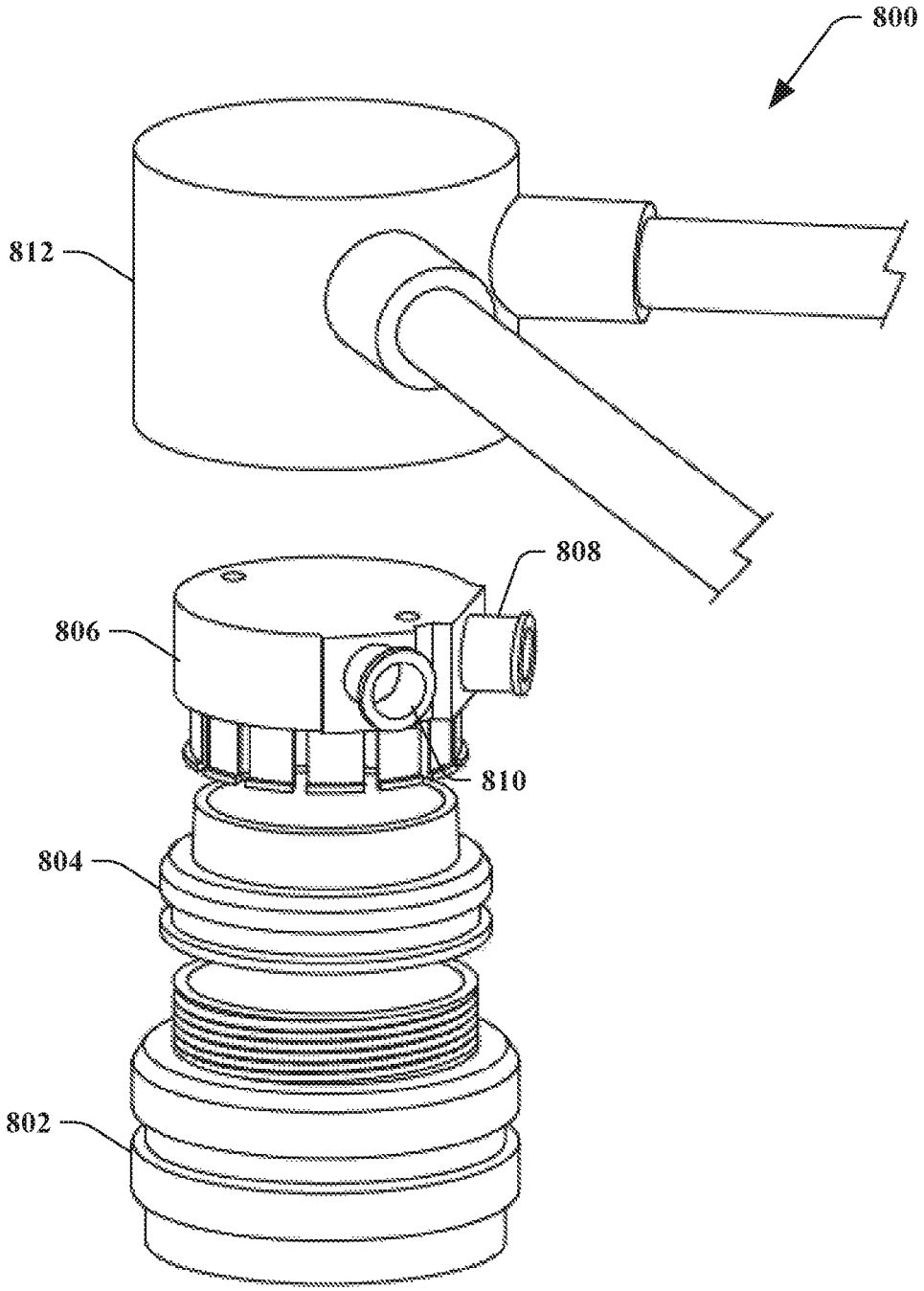
FIG. 8 illustrates another exemplary interconnect system.

Now referring to FIG. 8, illustrated is another exemplary interconnect system 800. As depicted in FIG. 8, the components of the interconnect system 800 have yet to be mechanically attached. The interconnect system 800 includes a connector 802 (e.g., the connector 102), an adapter ring 804 (e.g., the adapter ring 104), and a backshell 806 (e.g., the backshell 106). The backshell 806, for instance, can be the backshell 500 of FIG. 5; thus, the backshell 806 can include two ports (a port 808 and a port 810) located on a sidewall portion. However, it is to be appreciated that other backshells described herein that can be slid on to the adapter ring 804 can alternatively be included in the system 800.

Figure 9:
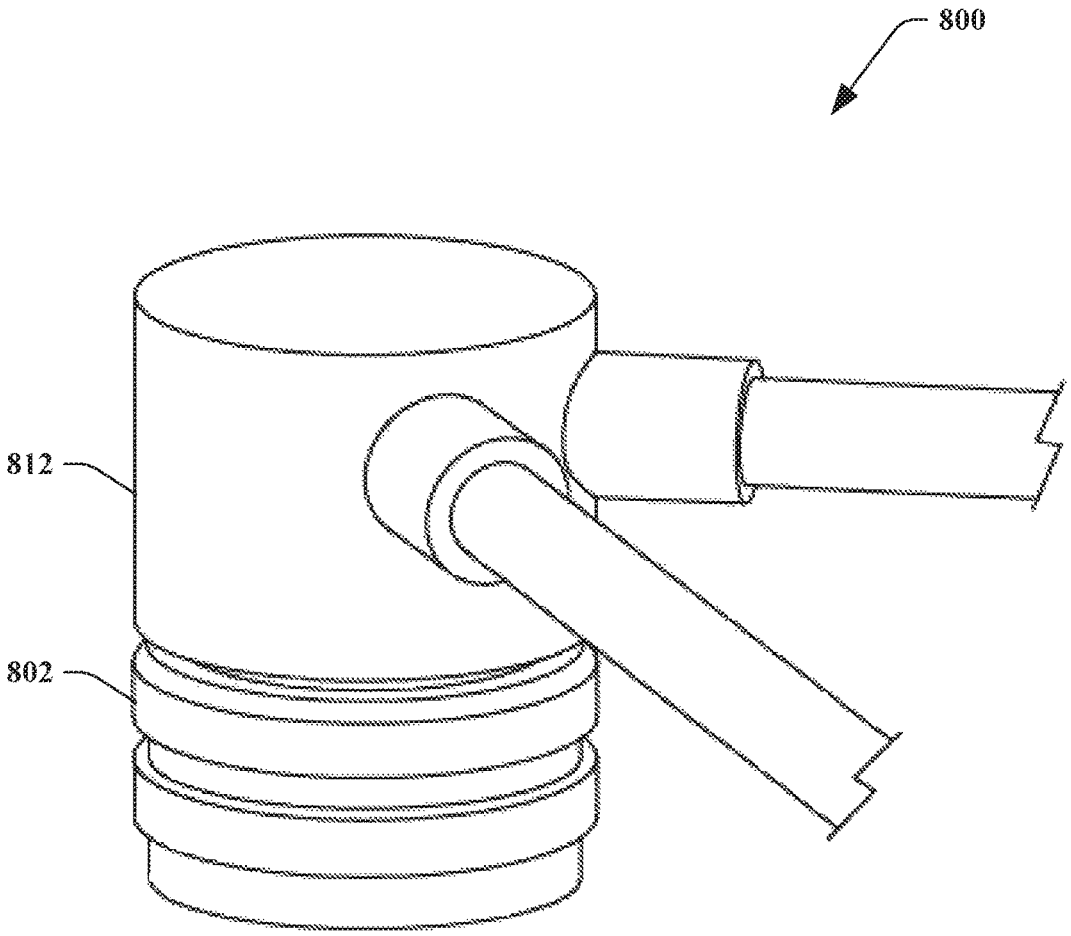
FIG. 9 illustrates the exemplary interconnect system of FIG. 8, where the components have been assembled together.

Once the connector 802, the adapter ring 804, and the backshell 806 are mechanically attached, with wire bundles coming out of the ports 808 and 810 of the backshell 806, the assembly can be encapsulated by encapsulation material 812. Moreover, FIG. 9 depicts the exemplary interconnect system 800 of FIG. 8, where the components have been assembled together. The encapsulation material 812 encapsulates the adapter ring 804 and the backshell 806 in the example shown in FIG. 9.

Figure 10:
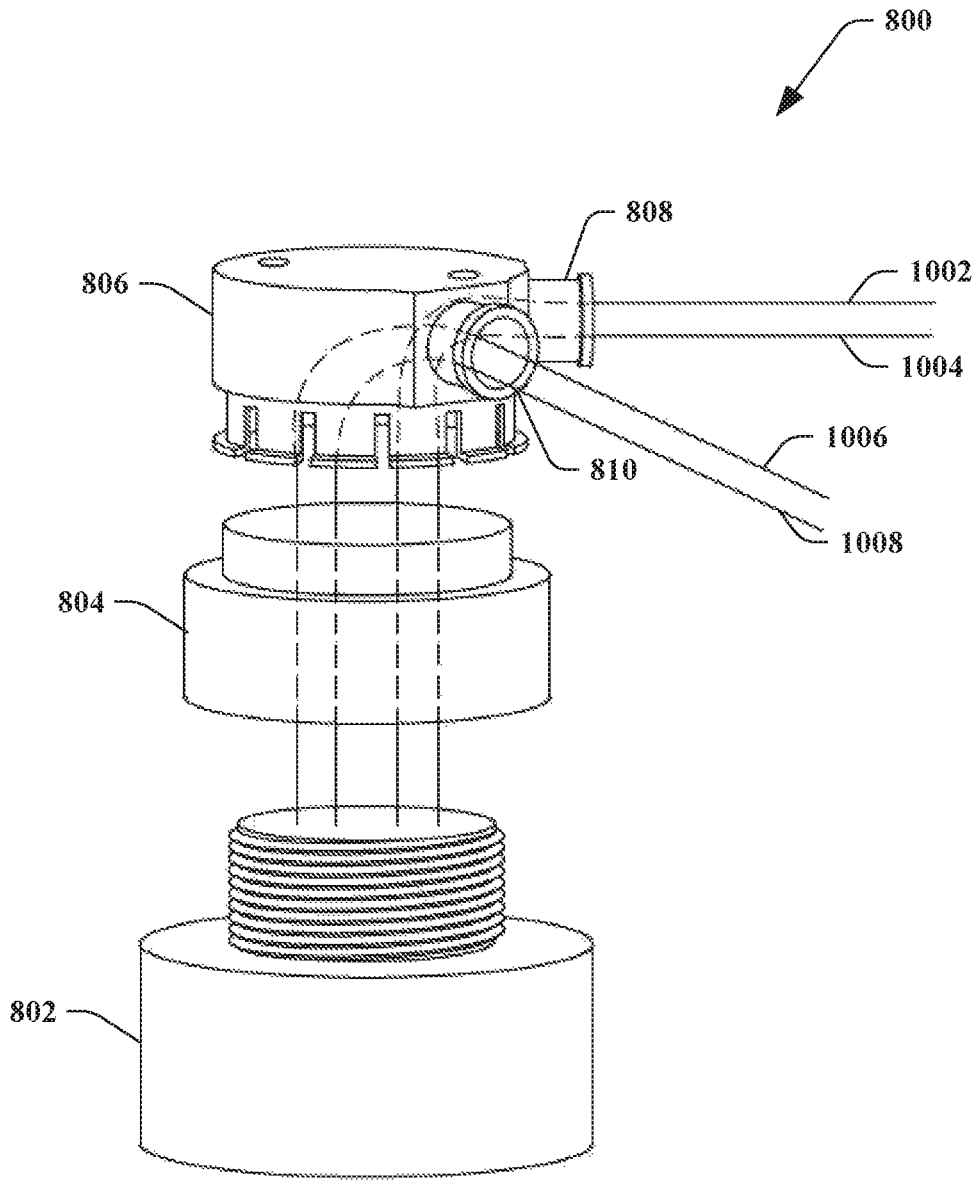
FIG. 10, FIG. 11, FIG. 12 and FIG. 13 illustrate an exemplary method of assembling the interconnect system of FIG. 8.

FIGS. 10-13 illustrate an exemplary method of assembling the interconnect system 800 of FIG. 8. As shown in FIG. 10, wire bundles can be fed through the backshell 806 and adapter ring 804 and soldered to contacts of the connector 802. Thus, a wire bundle (including a wire 1002 and a wire 1004) can be positioned to pass through the port 808 of the backshell 806 and the adapter ring 804, and the wire bundle can be attached to the connector 802. Likewise, a differing wire bundle (including a wire 1006 and a wire 1008) can be positioned to pass through the port 810 of the backshell 806 and the adapter ring 804, and this differing wire bundle can be attached to the connector 802.

Figure 11:
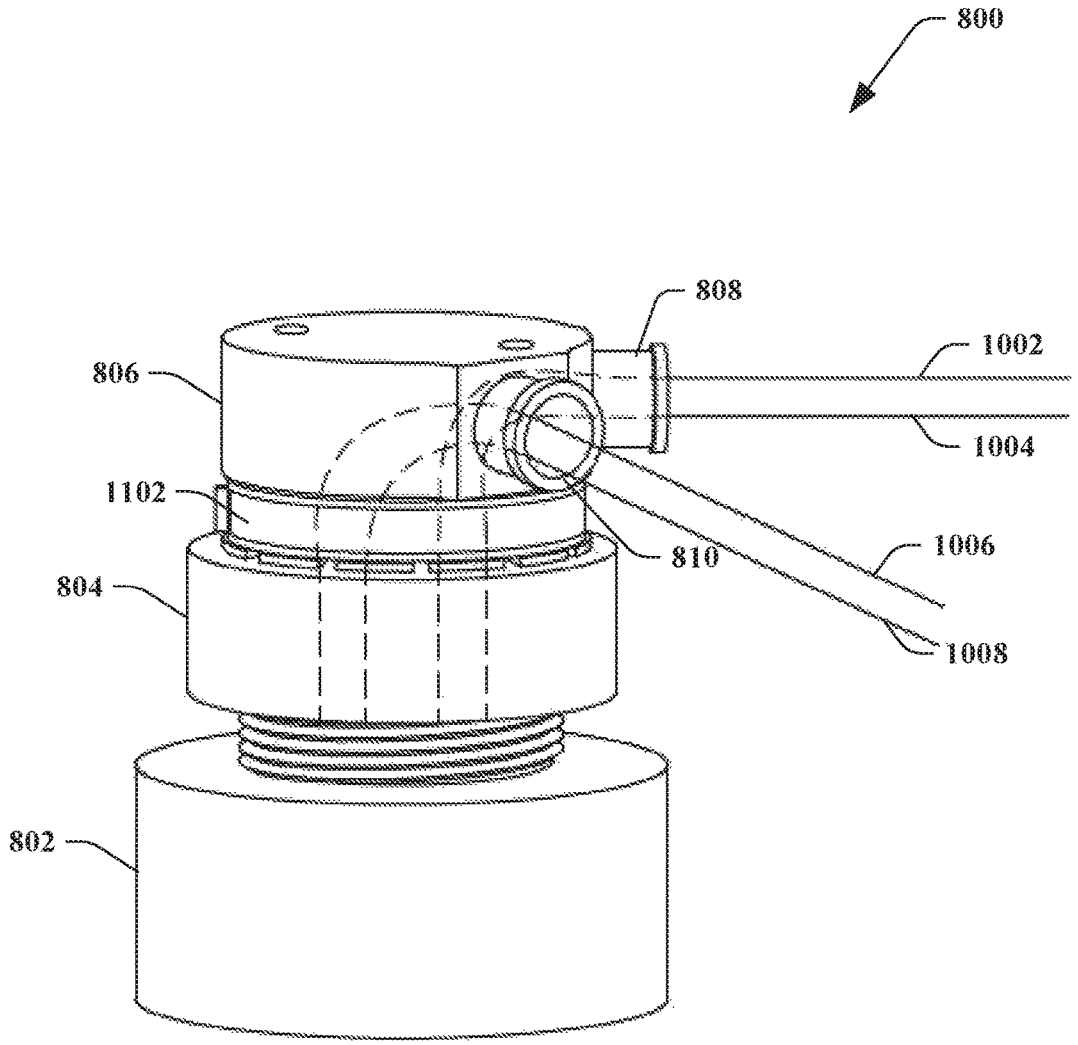

Turning to FIG. 11, a threaded proximal coupling portion of the adapter ring 804 can be attached to (e.g., screwed to) a threaded distal coupling portion of the connector 802. Thereafter, a proximal coupling portion of the backshell 806 can be attached to (e.g., slid on) a non-threaded distal coupling portion of the adapter ring 804. A band clamp 1102 can then be positioned around an outer surface of the proximal coupling portion of the backshell 806 to further secure the attachment of the backshell 806 and adapter ring 804. Thus, the band clamp 1102 can be positioned around outer surfaces of fingers of the proximal coupling portion of the backshell 806.

Once the backshell 806 is secured, the ports 808 and 810 can be sealed (e.g., using Room-Temperature-Vulcanization (RTV) silicone or some other type of sealing material). Moreover, an inside volume can be encapsulated (e.g., using aluminum oxide filled epoxy or some other type of encapsulation material) through fill holes of the backshell 806. The fill holes can then be plugged with plugs (e.g., copper plugs); the plugs can be held in place by the encapsulation material filling the inside volume.

Figure 12:
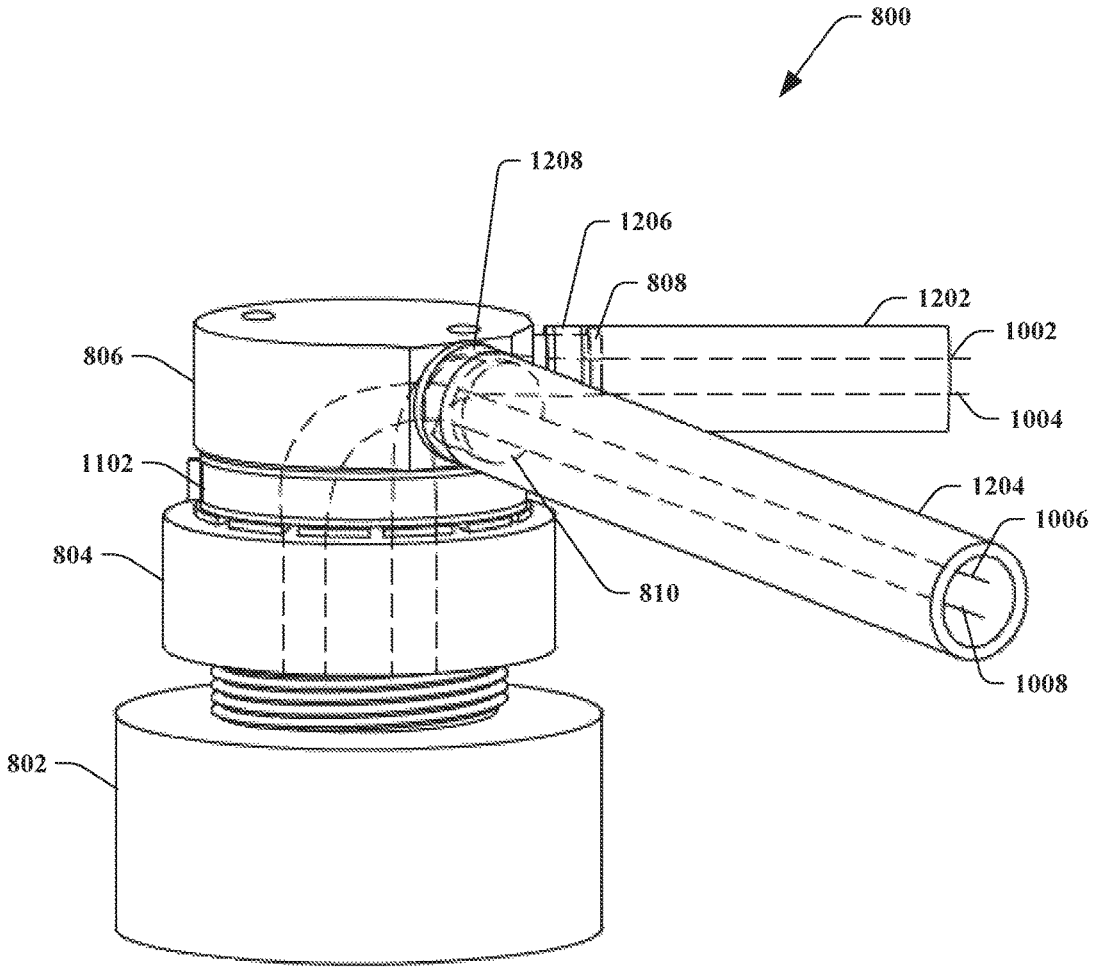

Reference is now made to FIG. 12. The encapsulation material is allowed to cure. An end of a shield 1202 is positioned around an outer surface of the port 808, where the wire bundle (including the wire 1002 and the wire 1004) is within the shield 1202. A band clamp 1206 is positioned around an outer surface of the shield 1202 at the end of the shield 1202 to secure the shield 1202 to the port 808. Similarly, an end of a shield 1204 is positioned around an outer surface of the port 810, where the differing wire bundle (including the wire 1006 and the wire 1008) is within the shield 1204. A band clamp 1208 likewise is positioned around an outer surface of the shield 1204 at the end of the shield 1204 to secure the shield 1204 to the port 810.

Figure 13:
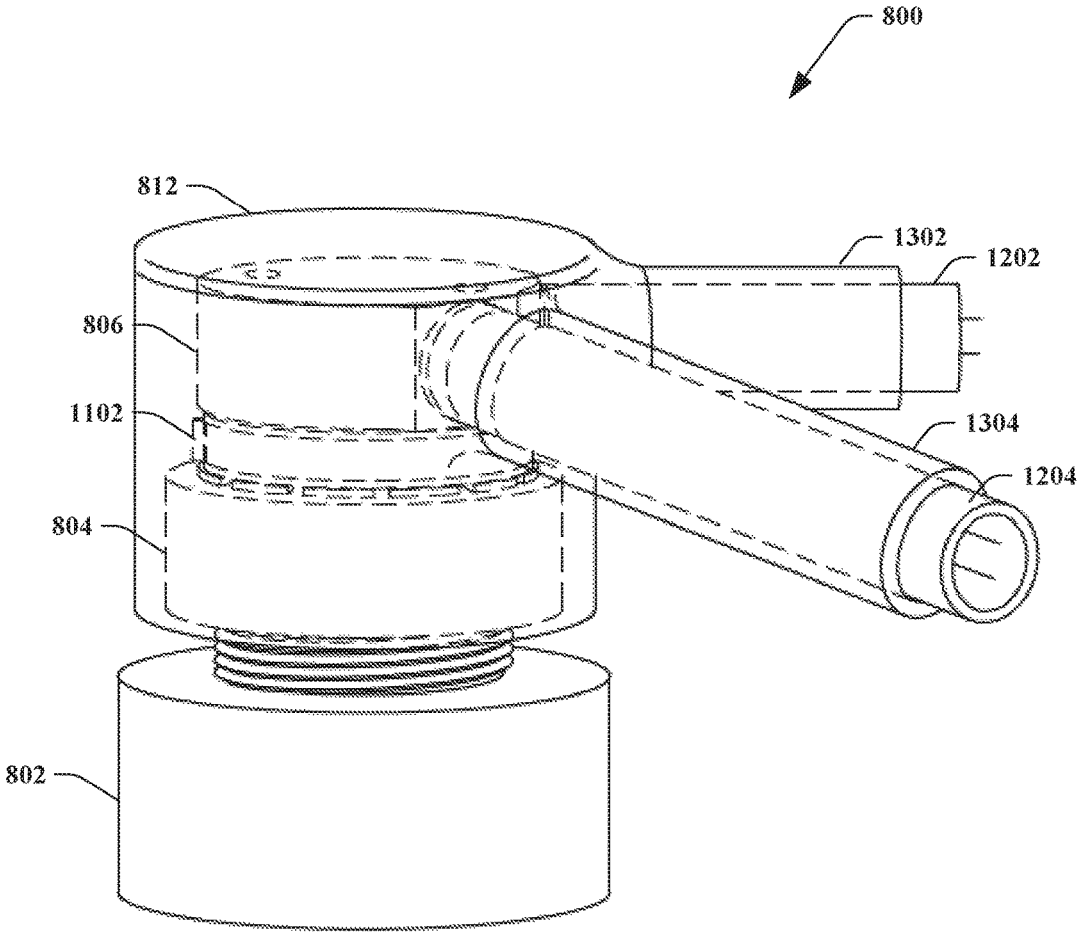

Turning to FIG. 13, outer jacketing 1302 can be positioned over the shield 1202, and outer jacketing 1304 can be positioned over the shield 1204. Further, the connector termination can be potted in the encapsulation material 812, if desired.

Further, as used herein, the term "exemplary" is intended to mean "serving as an illustration or example of something."

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An interconnect system, comprising:

a connector, the connector comprises a threaded distal coupling portion;

an adapter ring, the adapter ring comprises a threaded proximal coupling portion and a non-threaded distal coupling portion; and a backshell, the backshell comprises a proximal coupling portion and a port;

wherein the threaded proximal coupling portion of the adapter ring and the threaded distal coupling portion of the connector are mechanically attached;

wherein the non-threaded distal coupling portion of the adapter ring is positioned within the proximal coupling portion of the backshell; and wherein a wire bundle enters the backshell through the port, passes through the adapter ring, and terminates at the connector.

2. The interconnect system of claim 1, the proximal coupling portion of the backshell comprises fingers separated by gaps, wherein the proximal coupling portion of the backshell and the non-threaded distal coupling portion of the adapter ring are mechanically attached through a friction fit between inner surfaces of the fingers of the proximal coupling portion of the backshell and an outer surface of the non-threaded distal coupling portion of the adapter ring.

3. The interconnect system of claim 2, further comprising:

a band clamp, wherein the band clamp is positioned around outer surfaces of the fingers of the proximal coupling portion of the backshell.

4. The interconnect system of claim 2, the fingers of the proximal coupling portion of the backshell comprise rims on outer surfaces of the fingers at tips of the fingers.

5. The interconnect system of claim 1, the port of the backshell comprises a rim on an outer surface at an end of the port.

6. The interconnect system of claim 1, the backshell further comprises:

a cap portion; and a sidewall portion having a first end and a second end;

wherein the cap portion of the backshell is adjacent to the first end of the sidewall portion of the backshell such that the cap portion closes the sidewall portion at the first end; and wherein the proximal coupling portion of the backshell is adjacent to the second end of the sidewall portion of the backshell.

7. The interconnect system of claim 6, wherein the port is located on the cap portion of the backshell.

8. The interconnect system of claim 6, wherein the port is located on the sidewall portion of the backshell.

9. The interconnect system of claim 6, the backshell further comprises a differing port, wherein a differing wire bundle enters the backshell through the differing port, passes through the adapter ring, and terminates at the connector.

10. The interconnect system of claim 1, further comprising:

a shield, the shield terminates at the backshell such that an end of the shield is positioned around an outer surface of the port;

wherein the wire bundle is within the shield.

11. The interconnect system of claim 10, further comprising:

a band clamp, wherein the band clamp is positioned around an outer surface of the shield at the end of the shield.

12. The interconnect system of claim 10, further comprising:

a differing shield;

wherein the backshell further comprises a differing port;

wherein the differing shield terminates at the backshell such that an end of the differing shield is positioned around an outer surface of the differing port; and wherein a differing wire bundle is within the differing shield, enters the backshell through the differing port, passes through the adapter ring, and terminates at the connector.

* * * * *